US009845942B2

(12) United States Patent
Ladstaetter

(10) Patent No.: US 9,845,942 B2
(45) Date of Patent: Dec. 19, 2017

(54) LIGHT STRIP SYSTEM AND CONVERTER UNIT THEREFOR

(75) Inventor: Gerald Ladstaetter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 212 days.

(21) Appl. No.: 14/114,068

(22) PCT Filed: Apr. 26, 2012

(86) PCT No.: PCT/EP2012/057606

§ 371 (c)(1),
(2), (4) Date: Oct. 25, 2013

(87) PCT Pub. No.: WO2012/146636

PCT Pub. Date: Nov. 1, 2012

(65) Prior Publication Data

US 2014/0049954 A1 Feb. 20, 2014

(30) Foreign Application Priority Data

Apr. 28, 2011 (DE) ..... 10 2011 017 702

(51) Int. Cl.
*F21V 23/02* (2006.01)
*F21V 21/35* (2006.01)
(Continued)

(52) U.S. Cl.
CPC ..... *F21V 23/023* (2013.01); *F21S 4/20* (2016.01); *F21V 21/35* (2013.01); *F21V 23/026* (2013.01);
(Continued)

(58) Field of Classification Search
CPC .. F21S 4/003; F21S 8/038; F21S 8/066; F21S 4/20; F21V 21/35; F21V 23/023;
(Continued)

(56) References Cited

U.S. PATENT DOCUMENTS 3,430,039 A * 2/1969 Piccola ..... F21V 21/00 362/228
3,718,816 A * 2/1973 Seelbach ..... F21V 21/35 174/99 B (Continued)

FOREIGN PATENT DOCUMENTS

DE 19531351 2/1997
DE 10140495 2/2003

(Continued)

OTHER PUBLICATIONS

Vamberszky Klaus, Supply track system, Nov. 29, 2001, WO0191248, English translation.*

(Continued)

*Primary Examiner* — Bryon T Gyllstrom
*Assistant Examiner* — James Endo
(74) *Attorney, Agent, or Firm* — Brooks Kushman P.C.

(57) ABSTRACT

A light strip system for securing luminaire units and supplying them with power having an elongate support structure, especially at least one support rail for securing the luminaire units and power supply extending along the support structure for supplying the luminaire units with power. The power supply includes first lines which extend along the support structure and define a first power supply circuit (I), and second lines which extend over part of the length of the first power supply circuit (I) along the support structure and define a second power supply circuit (II) which is designed to be in electrical contact with the luminaire units, the first power supply circuit (I) being coupled to the second power supply circuit (II) by a converter unit which converts a first supply voltage available in the first power supply circuit (I) to a second supply voltage suitable for operating the luminaire units.

18 Claims, 3 Drawing Sheets

(51) Int. Cl.

| | |
|---|---|
| ***F21S 4/20*** | (2016.01) |
| *H01R 25/14* | (2006.01) |
| *F21V 21/34* | (2006.01) |
| *F21S 8/00* | (2006.01) |
| *F21S 2/00* | (2016.01) |
| *F21V 21/02* | (2006.01) |
| *F21V 23/04* | (2006.01) |
| *F21V 23/06* | (2006.01) |
| *H01R 31/06* | (2006.01) |
| *F21Y 115/10* | (2016.01) |

(52) U.S. Cl.
CPC ..... *H01R 25/142* (2013.01); *F21S 2/005* (2013.01); *F21S 8/038* (2013.01); *F21V 21/025* (2013.01); *F21V 21/34* (2013.01); *F21V 23/02* (2013.01); *F21V 23/0464* (2013.01); *F21V 23/0471* (2013.01); *F21V 23/06* (2013.01); *F21Y 2115/10* (2016.08); *H01R 25/14* (2013.01); *H01R 25/147* (2013.01); *H01R 31/06* (2013.01)

(58) Field of Classification Search
CPC ..... F21V 23/026; F21V 21/34; F21V 21/025; F21V 23/02; H01R 25/142; H01R 25/147; H01R 25/14; H01R 25/162; H01R 4/64; H01R 25/145
USPC ..... 362/648; 439/121, 532, 111, 110, 122, 439/116, 112, 115, 119
See application file for complete search history.

(56) References Cited

U.S. PATENT DOCUMENTS

| | | | | | |
|---|---|---|---|---|---|
| 3,757,273 | A * | 9/1973 | Hesse | H01R 25/142 | 439/117 |
| 3,933,403 | A * | 1/1976 | Rubesamen | H01R 25/142 | 439/121 |
| 4,053,194 | A * | 10/1977 | Gilman | H01R 25/145 | 439/115 |
| 4,508,400 | A * | 4/1985 | Herbert | H01R 25/14 | 439/207 |
| 4,591,764 | A * | 5/1986 | Nilssen | H05B 39/00 | 315/172 |
| 4,655,520 | A * | 4/1987 | Cummings | F21V 21/002 | 439/111 |
| 4,688,154 | A * | 8/1987 | Nilssen | F21V 21/35 | 307/157 |
| 4,822,292 | A * | 4/1989 | Thayer | H01R 25/142 | 439/115 |
| 4,876,633 | A * | 10/1989 | Engel | F21V 7/0016 | 362/223 |
| 4,994,944 | A * | 2/1991 | Vernondier | E04F 19/061 | 362/219 |
| 6,033,097 | A * | 3/2000 | Harwood | F21V 21/34 | 362/147 |
| 6,246,182 | B1 * | 6/2001 | Yamasaki | H05B 39/00 | 315/209 R |
| 6,274,817 | B1 * | 8/2001 | Jaakkola | H01R 25/14 | 174/68.1 |
| 6,439,749 | B1 * | 8/2002 | Miller | F21S 8/02 | 362/239 |
| 6,597,129 | B2 * | 7/2003 | Newman | H01R 25/14 | 315/291 |
| 7,188,805 | B2 * | 3/2007 | Henley | B64D 11/06 | 244/118.5 |
| 7,819,676 | B1 * | 10/2010 | Cardoso | H01R 13/245 | 439/115 |
| 2003/0021111 | A1 * | 1/2003 | Miller | H01R 25/14 | 362/648 |
| 2003/0021116 | A1 * | 1/2003 | Miller | F21S 8/00 | 362/249.01 |
| 2003/0223234 | A1 * | 12/2003 | Tang | H01R 25/142 | 362/648 |
| 2004/0257802 | A1 * | 12/2004 | Helenowski | A47B 61/003 | 362/217.08 |
| 2005/0141219 | A1 | 6/2005 | Skegin | | |
| 2006/0039168 | A1 * | 2/2006 | Mier-Langner | F21S 8/038 | 362/648 |
| 2010/0254146 | A1 * | 10/2010 | McCanless | F21V 29/745 | 362/368 |
| 2011/0261508 | A1 * | 10/2011 | Ross | H01R 25/14 | 361/624 |
| 2012/0092875 | A1 * | 4/2012 | Cho | F21S 2/005 | 362/311.01 |

FOREIGN PATENT DOCUMENTS

| | | | | |
|---|---|---|---|---|
| DE | 102008036474 | | 2/2010 | |
| DE | 202010006329 | | 8/2010 | |
| DE | 202010005681 | | 9/2010 | |
| EP | 1045201 | | 10/2000 | |
| EP | 1241760 | | 9/2002 | |
| EP | 2026425 | A2 * | 2/2009 | H01R 25/142 |
| EP | 2151899 | | 2/2010 | |
| WO | 8605121 | | 9/1986 | |
| WO | 0191249 | | 11/2001 | |

OTHER PUBLICATIONS

Noh Shi Youl, Fluorescent lamp has plug and socket which are respectively installed on fluorescent lamp fixtures at both sides of lamp main body for respectively receiving and applying predetermined signal and power, Feb. 27, 2003, DE10140495, English translation.*

Gadner Wolfgang, Electricity rail system, Feb. 18, 2009, EP2026425A2, English translation.*

International Search Report for PCT/EP2012/057606, English Translation attached to original, Both completed by the European Patent Office dated Nov. 7, 2012, All together 7 Pages.

* cited by examiner

LIGHT STRIP SYSTEM AND CONVERTER UNIT THEREFOR

CROSS-REFERENCE TO RELATED APPLICATION

This application is the U.S. national phase of PCT Application No. PCT/EP2012/057606 filed on Apr. 26, 2012, which claims priority to German Patent Application No. 10 2011 017 702.7 filed on Apr. 28, 2011, the disclosures of which are incorporated in their entirety by reference herein.

The present invention relates to a light strip system for securing and supplying power to a plurality of luminaire units. In addition, the invention relates to a converter unit, which is provided for use in such a light strip system.

Light strip systems are used in a wide variety of application cases since they enable a flexible arrangement of even different luminaire units and can correspondingly be matched individually to different conditions in a simple manner, in contrast to permanently installed individual luminaires. In general, a light strip system has an elongate mounting structure, in particular one or more mounting rails for securing the luminaire units, wherein power supply means for supplying power to the luminaire units are provided at the same time within or on the mounting structure.

A known light strip system of this type is marketed by the applicant under the designation Tecton. This light strip system, which is described in WO 01/91249 A1, for example, is characterized by the fact that the luminaire units can be arranged in any desired position on the mounting structure, which is achieved by a special arrangement and mounting of the lines for the power supply. In particular, provision is made for the electrical conductors held in special so-called current-conducting profiles to be accessible over the entire length of the mounting structure and nevertheless the effects occurring as a result of temperature fluctuations in respect of different length expansions of the components of the light strip system to be compensated for. Only by these special measures is it possible for a luminaire unit to be positioned at any desired point.

Furthermore, however, light strip systems are also known in which the luminaire units can be arranged merely at predetermined positions, wherein these positions are in each case predetermined by corresponding contact-making elements, which enable connection of the luminaires to the power supply. Since the luminaire units generally have standard lengths, the contact-making elements can be positioned on the mounting structure in a manner determined by these lengths.

In the previous light strip systems, luminaire units were generally used which contained fluorescent lamps as light sources. These luminaire units then generally had so-called electronic control gear for operating the light sources, which converted the grid supply voltage made available by the light strip system into a suitable operating voltage for the associated lamp(s). Since the length of a fluorescent lamp is in any case much greater than the length of an electronic control gear, the use of such a lamp operating device did not have any effect on the configuration of the luminaire unit, in particular on the length dimensions thereof.

In the meantime, however, LED-based light sources are being used increasingly in lighting technology. Such light sources cannot be connected directly to the general supply voltage, which is in the region of 230 volts, for example. Instead, they require a much lower, so-called low voltage, for example in the region of 24 volts. Luminaire units with such LED light sources therefore in turn require a so-called converter unit, which converts the supply voltage made available by the light strip system, which is generally a so-called high voltage, into the low voltage required for operating the LED light sources.

Since, however, LED light sources are virtually point light sources, the length of such a luminaire unit, which has one or more LED light sources and a converter unit, is now critically influenced by the dimensions of the converter unit. This means that luminaire units with LED light sources, which are provided for use in the known light strip systems, have a certain minimum length. As a result, however, the flexibility in use of LED light sources in light strip systems is severely restricted.

It would be obvious at first glance to provide the low voltage required for the operation of the LED light sources already on the lines for supplying power to the light strip system. With such a low voltage, however, the losses in the electrical lines are comparatively high, with the result that only very short light strip systems can be realized in this way.

Therefore, the present invention is based on the object of specifying a novel solution for light strip systems which makes it possible to arrange luminaire units with LED light sources over a relatively long length as well and to supply current to said luminaire units in a suitable manner.

The object is achieved by a light strip system for securing and supplying power to a plurality of luminaire units having the features of claim 1. In addition, according to the invention, a converter unit for use in a corresponding light strip system as claimed in claim 16 is also proposed. Advantageous developments of the invention are the subject matter of the dependent claims.

The solution according to the invention is based on the concept of making available the low supply voltage required for operating the luminaire units with LED light sources in each case over a limited length of the mounting structure of a light strip system. For this, converters are used which each apply the low voltage to power supply lines over a certain section of the system. Then, the luminaire units with the LED light sources can be connected flexibly to these supply lines, and current is supplied to the converters in turn via separate lines. The luminaire units no longer require a dedicated converter in this solution and can be designed correspondingly compactly or individually in terms of their length.

Accordingly, the invention proposes a light strip system for securing and supplying power to luminaire units, wherein the system has:

- an elongate mounting structure, in particular at least one mounting rail for securing the luminaire units and
- power supply means extending along the mounting structure for supplying power to the luminaire units, wherein the power supply means have:
  - first lines, which preferably extend substantially over the entire length of the mounting structure and which form a first power supply circuit,
  - second lines, which extend over a partial length of the mounting structure or the first power supply circuit and form a second power supply circuit, which is provided for making electrical contact by means of the luminaire units, and wherein the coupling between the first power supply circuit and the second power supply circuit takes place by means of a converter unit, which converts a first supply voltage available in the first power supply circuit into a second supply voltage suitable for operating the luminaire units. As already mentioned, the first supply voltage can preferably be a high voltage, while the second supply voltage is a low voltage which can be used by the luminaire units, preferably having LED light sources.

The basic concept of the present invention therefore consists in providing a combination of high-voltage supply and low-voltage supply, which ultimately enables the connection of luminaire units with LED light sources to the light strip system.

In the light strip system according to the invention, preferably a plurality of second power supply circuits are formed, which are each connected to the first power supply circuit via an associated converter unit. The converter units arranged at certain intervals are then connected to one another via the common high-voltage supply and provide, sectionally, in each case the low voltage required for operating the luminaire units. In this case, provision is preferably made for the second power supply circuits to each abut one another at their ends and to extend together substantially over the entire length of the mounting structure. For example the second circuits can also be connected to one another at their ends. As a result, ultimately the possibility is provided of the luminaire units being capable of being positioned substantially freely over the entire length of the mounting structure. This is particularly advantageous since, owing to the compact dimensions of the LED light sources, the luminaire units now no longer need to have standard lengths, but can instead have different dimensions. In this case, the advantage of a flexible arrangement comes to bear in particular.

Preferably, the lines of the second power supply circuit(s) are arranged so as to be freely accessible from a fitting side of the mounting structure. As a result, the flexible arrangement and connection of the luminaire units to the second power supply circuit(s) is simplified. Since a low voltage is present at the corresponding lines, no special protective measures need to be provided, also in comparison with the lines of the first power supply circuit, by means of which unintentional touching contact with the lines is prevented.

The power supply to the converter units is performed, as already mentioned, by the first power supply circuit. In this case, in accordance with a first exemplary embodiment, provision can be made for the lines of the first power supply circuit to have, at predetermined intervals, contact-making means for connecting a converter unit. In this case, the positions for the converter units are predetermined and are preferably selected such that the associated second power supply circuits have a length at which the losses occurring are not excessive. As an alternative to this, however, provision could also be made for the lines of the first power supply circuit to be formed and mounted in such a way that they enable a substantially free arrangement of the converter units. For this, for example, the configuration of the already mentioned light strip system Tecton could be used.

The mounting structure of the light strip system according to the invention is preferably formed by one or more substantially U-shaped mounting rails. In this case, provision can then be made for the lines of the first power supply circuit to run within the mounting rail. The lines of the second power supply circuit(s), on the other hand, are preferably arranged in the vicinity of the opening of the mounting rail since, in this case, contact-making by means of the luminaire units is facilitated. In addition, provision can also additionally be made for further second power supply circuits to be arranged on the side remote from the opening of the mounting rail. Then, for example, additional luminaire units which are used for implementing indirect lighting could be arranged in this region of the mounting structure.

The converter units are preferably arranged in the center of the associated second power supply circuit, when viewed in the longitudinal direction of the light strip system. However, it would also be conceivable for the converter units to be arranged in the center of two adjacent power supply circuits and to be connected to the two second circuits. In this case, a converter unit can then be used to provide a low voltage over a length of approximately 4 to 8 meters.

As already mentioned, the present invention also relates to a converter unit for supplying power to a plurality of luminaire units, wherein the converter unit has, according to the invention:

- means for fastening to the mounting structure of a light strip system, in particular to a mounting rail,
- means for making contact with lines running on or within the mounting rail of a first power supply circuit,
- means for making contact with lines running on or within the mounting structure of a second power supply circuit,
- means for converting a first supply voltage available in the first power supply circuit into a second supply voltage suitable for operating the luminaire units.

In this case, the means for making contact with the first power supply circuit can have, for example, a so-called rotary tap. Preferably, both electrical contact-making with the lines of the first power supply circuit and mechanical locking on the mounting structure of the light strip system is achieved via said rotary tap. The means for making contact with the second power supply circuit preferably have a plug connected to the housing of the converter unit via a flexible line.

The invention will be explained in more detail below with reference to the attached drawing, in which.

Figure 1:
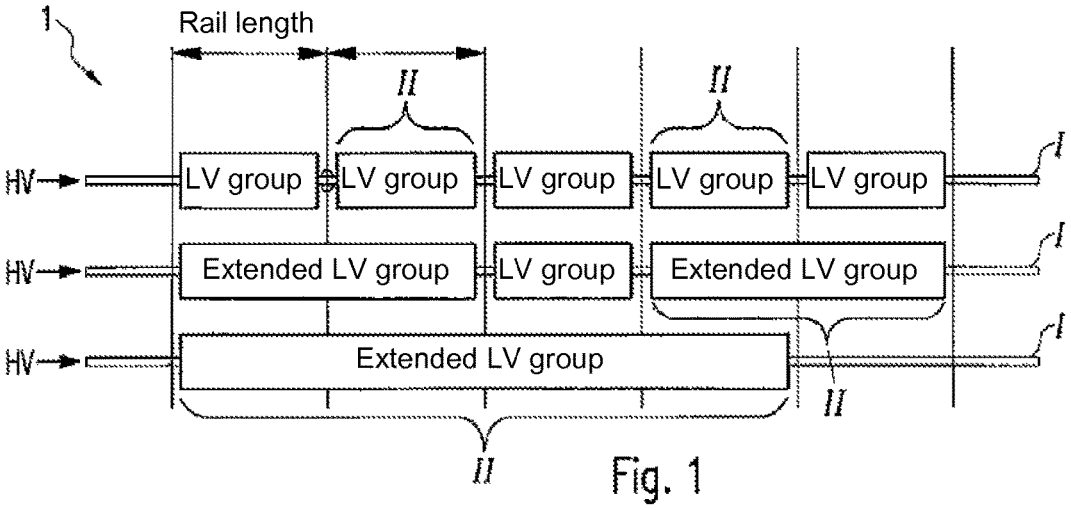
FIG. 1 shows a schematic illustrating the concept according to the invention of a light strip system with a combined high voltage and low voltage supply.

The concept on which the present invention is based will be explained briefly first with reference to the schematic illustration in FIG. 1.

In this case, three light strip systems are illustrated schematically one below the other, which light strip systems first have in each case one first power supply circuit I, at which a high supply voltage (HV) is present, wherein this first power supply circuit I preferably extends over the entire length of the mounting structure of the light strip system 1. Generally, the mounting structure comprises a plurality of mounting rails which are attached to one another and connected to one another.

If the intention is to connect luminaire units to this light strip system 1 which require a low supply voltage (LV), there is now the problem that this low voltage cannot be applied to lines of the first circuit I, which extends over the entire light strip system or at least over a relatively long length, since the losses resulting from this over the entire length of the first circuit I would be too high.

According to the invention, therefore, additional second circuits II are formed, at which in each case the desired low voltage is present and which each extend only over a section of the light strip system or the first circuit I, wherein the second power supply circuits II are each supplied via a converter unit. Therefore, the converter unit takes on the function of the coupling between the first power supply circuit I and the power supply circuit II and in particular converts the high voltage HV of the first power supply circuit I into the suitable low voltage LV. In this way, in each case so-called low voltage groups are formed over a limited length, i.e. all of the luminaire units which are connected to the corresponding second power supply circuit II of such an LV group are supplied with current locally from a common converter unit. These second power supply circuits II now have only a limited length, however, as has already been mentioned, with this length being dimensioned such that the line losses resulting do not become excessively high. Owing to the fact that a plurality of second power supply circuits II are arranged adjacent to one another, however, there is again the possibility of connecting luminaire units which require the low voltage over the entire length of the light strip system 1.

At this point, however, express reference should be made to the fact that the entirety of the second power supply circuits II does not necessarily need to cover the complete light strip system or the first power supply circuit I. For example, it would be quite conceivable for luminaire units with LED light sources to be arranged only in a subregion of the light strip system, whereas the rest of the region of the light strip system is used by high-voltage luminaire units. In this case, the second power supply circuits II according to the invention can only be formed in the corresponding sections, wherein, in particular, it would also be conceivable to implement only a single second power supply circuit II in the light strip system. In addition, the first power supply circuit I would also not necessarily need to extend over the entire length of the mounting structure.

FIG. 1 now first shows, in the upper region, a first variant for arranging the second power supply circuits II, in which arrangement the individual low voltage groups are isolated from one another and each have a length which corresponds to an individual rail length of the mounting structure. In this case, therefore, each individual rail has an associated converter unit, which supplies power to the associated low voltage group or the associated second power supply circuit II. The corresponding second power supply circuits II can in this case be isolated from one another, as illustrated, and adjoin one another at the end or else in each case be connected to one another at their ends. In addition, a second variant is illustrated in which two so-called extended low voltage groups are also used. In this case, the associated converter unit is arranged at the transition between two adjacent low voltage groups and supplies the required low supply voltage to both low voltage groups, as a result of which a relatively long length for the extended low voltage group is achieved. This principle has been used once again in the third, lower variant, wherein, however, the length of the extended low voltage group cannot be increased as desired since, otherwise, the line losses would rise again. The length of a low voltage group can in this case also be dependent, inter alia, on which and how many luminaire units are intended to be arranged at the second power supply circuit. Lengths in the range of from 4 m to 8 m are realistic, wherein a length for an extended low voltage group in the region of up to 16 m can be achieved for the case where a converter supplies two adjacent power supply circuits II.

The basic concept of the invention therefore consists in that converter units are connected to the first power supply circuit which extends substantially over the entire or a relatively long length of the light strip system and then each supply the low voltage to local regions, as a result of which second power supply circuits with limited length are formed, to which the luminaire units are then connected. In this case there are different possibilities for implementing this concept, which will be explained below with reference to the remaining figures.

Figure 2:
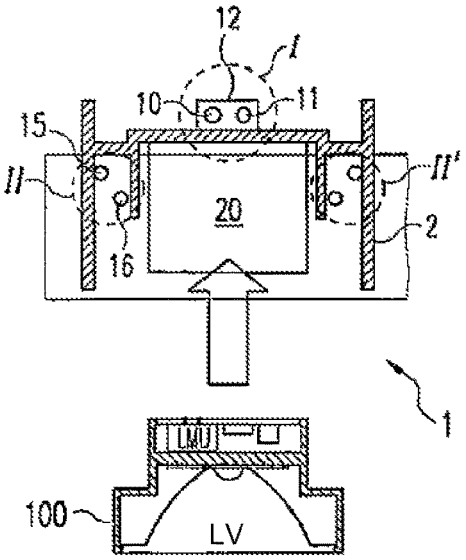
FIG. 2 shows a first exemplary embodiment for implementing a light strip system according to the invention.

In this case, FIG. 2 first shows a sectional illustration of a first exemplary embodiment of a light strip system 1 according to the invention, wherein in this case the first power supply circuit I is formed by cables 10, 11, which, in the present case, run on the upper side of a mounting rail 2. Of course it is possible here for the arrangement of the cables 10, 11 to also have a different configuration. In addition, the first power supply circuit I can also comprise considerably more cables in order to enable, for example, a phase selection and/or the transmission of control signals, as is known from light strip systems.

The mounting rail 2 is substantially U-shaped and is open towards the lower side in order to enable the attachment of luminaire units 100. These luminaire units are in particular luminaire units 100 in which LED light sources 105 are used and which correspondingly require a low voltage. This low voltage is now made available by virtue of the fact that converter units 20 are arranged at regular intervals on the light strip system 1 and are connected to the first power supply circuit I. For example, contact elements 12 could be provided at specific positions on the light strip system 1, by means of which contact elements the converter units 20 are coupled in order to be supplied with current via the first power supply circuit I.

A converter unit 20 itself then converts the high voltage of the first power supply circuit I into a low voltage and makes available this low voltage via lines 15, 16 which form the second power supply circuit II. Then, the luminaire units 100 can be connected to this second power supply circuit II, wherein said luminaire units firstly make contact with the lines 15, 16 and secondly are fastened mechanically on the mounting rail 2.

As already mentioned, the converter units 20 are arranged at specific intervals and in each case supply associated luminaire units 100 locally over a specific region, which luminaire units then form the associated low voltage group. The arrangement of the converter units 20 and the second power supply circuits II is preferably such that the luminaire units 100 can be arranged substantially over the entire length of the light strip system 1. This is to say that the entirety of the second power supply circuits II preferably substantially covers the entire length of the light strip system 1, wherein, as mentioned above, the second power supply circuits II can only be provided in certain sections. As shown in FIG. 2, in addition second power supply circuits II and II' can also be formed on both sides of the mounting rail 2, which second power supply circuits enable the additional arrangement of further luminaire units 100.

Figure 3:
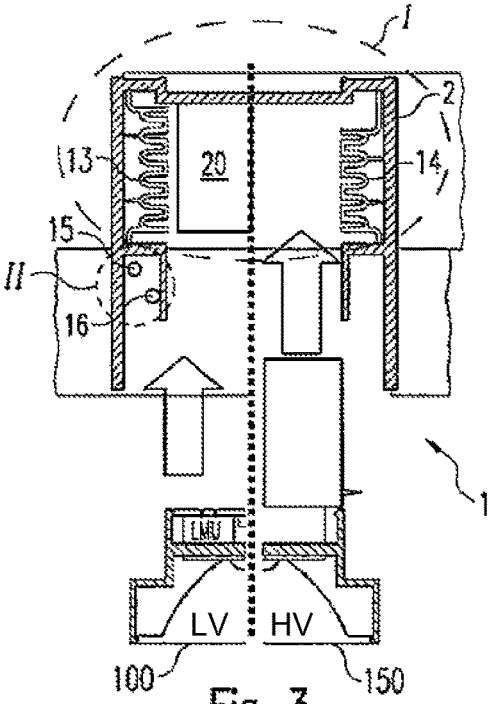
FIG. 3 shows a second exemplary embodiment of a light strip system according to the invention.

A development of the light strip system illustrated in FIG. 2 is illustrated in FIG. 3. This differs primarily in respect of the arrangement of the lines of the first power supply circuit I and correspondingly the contact-making of the first power supply circuit I by the converter units 20. Provision is made here for so-called current-conducting profiles 13, 14 for mounting lines of the first power supply circuit I for power supply and signal transmission to be arranged within an upper accommodating region of the mounting rail 2 on both sides. These current-conducting profiles 13, 14 are plastic parts, by means of which grooves which are open toward the interior of the mounting rail 2 are formed, in which grooves the lines are mounted. Such a technology is known, for example, from the already mentioned light strip system Tecton or from WO 01/91249 A1, which is associated with the particular advantage that contact can be made with the lines of the first power supply circuit I over the entire length of the light strip system 1.

Figure 4:
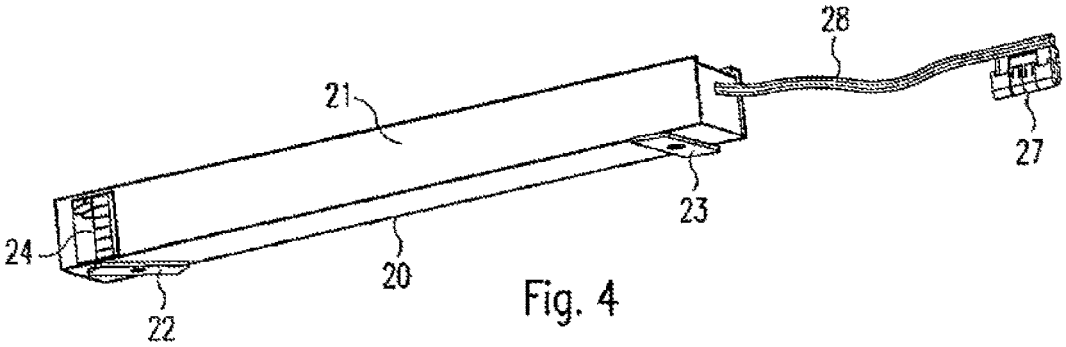
FIG. 4 shows a converter unit according to the invention which is used in the variant shown in FIG. 3.

The connection of a converter unit 20 to the lines of the first power supply circuit I is now performed by virtue of the fact that the converter unit 20 is inserted into the mounting rail 2 and fixed mechanically, wherein, at the same time, contacts are also pivoted out, via which contact is made with the lines located in the current-conducting profiles 13, 14. A corresponding converter unit is illustrated in FIG. 4 and has an elongate housing 21, in which, in particular, the means for converting the high voltage into the low voltage are arranged. Two lateral pivoting levers 22, 23 are arranged on the lower side of the housing, via which pivoting levers mechanical locking on the mounting rail 2 is achieved. In this case, a contact-making element 24 in the form of a so-called rotary tap 24 is also coupled to one of the two pivoting levers 22, via which rotary tap two contacts 25, 26 are pivoted out laterally. In the inserted state of the converter unit 20 in the mounting rail 2, the contacts 24, 25 (see FIG. 5) are then pivoted out laterally, with the result that they engage in the grooves in the current-conducting profiles 13, 14 and come to bear against the corresponding lines of the first power supply circuit I. As a result, the converter unit 20 is supplied with current. Preferably, in this case, the rotary tap 24 is formed in such a way that at least one of the contacts 25, 26 is adjustable, in particular vertically adjustable, with the result that phase selection is possible.

Furthermore, the converter unit 20 in addition also has a plug 27, which is connected to the housing 21 via a flexible line 28. Then, the connection of the converter unit 20 to the lines 15, 16 of the second power supply circuit II is performed via this plug 27. The flexible connecting line 27 in this case facilitates the connection of the plug 27, via which ultimately the low voltage is provided, to the lines of the second power supply circuit II. If the converter unit 20 is intended to supply two adjacent low voltage groups, the plug 27 can also be in the form of a corresponding bridge.

As can be seen from FIG. 3, the lines 15, 16 of the second power supply circuit II are arranged in the region of the opening of the mounting rail 2 and are correspondingly more easily accessible in comparison with the lines of the first power supply circuit I or the current-conducting profiles 13, 14. This is possible since, in the case of the low voltage present at the lines of the second power supply circuit II, no special measures need to be taken to prevent unintentional touching contact with these lines 15, 16. In contrast, corresponding protective measures in the lines of the first power supply circuit I are absolutely necessary, for which reason these lines preferably run in the interior of the mounting rail 2. Contact-making with the lines of the second power supply circuit II by the luminaire units 100 can correspondingly take place in a simple manner by means of a plug-type contact 101, which is arranged laterally, as illustrated in FIG. 5.

In this second variant, too, provision is made in principle for the converter units 20 to be arranged at regular intervals on the light strip system 1 and to supply the low voltage to the respectively surrounding region. In this case, provision can now also be made, however, for other luminaire units 150 (see FIG. 3) to be arranged in regions in which no converter units 20 are arranged on the mounting rail 2, which other luminaire units 150 require a high voltage supply for operation. These high-voltage luminaire units 150, which may be, for example, emergency luminaires for ensuring an emergency lighting supply, are inserted into the mounting rail 2 in the same way as the converter units 20 and have contact-making elements, with which contact can be made with the lines of the first power supply circuit I running in the current-conducting profiles 13 and 14. In this second variant, a more flexible arrangement of different luminaire units 100, 150 is thus once again possible.

Figure 5:
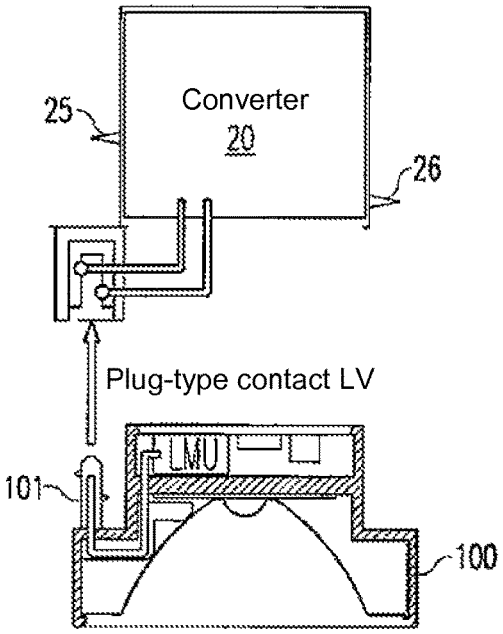
FIG. 5 shows the procedure for supplying power to a luminaire unit.
Figure 6:
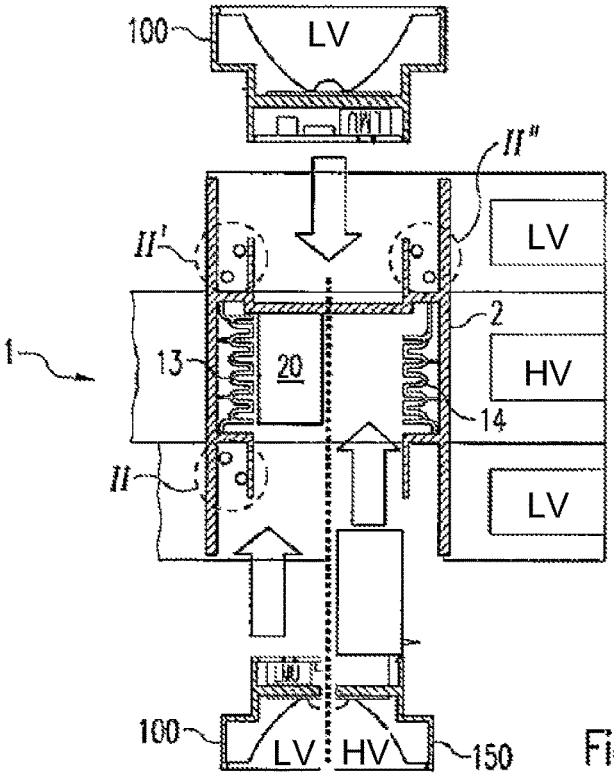
FIG. 6 shows a third exemplary embodiment of a light strip system according to the invention.

Finally, FIG. 6 shows a third variant of a light strip system 1, which is based on the variant in FIGS. 3-5. In addition, in this case second lines 15' and 16' or 15" and 16" also run in the upper part of the mounting rail, however, via which second lines further second power supply circuits II' and II" or corresponding low-voltage groups are formed. Therefore, further luminaire units 100 can now be connected to the upper side of the light strip system 1, which further luminaire units can now be used for implementing indirect lighting. In the mounting rail 2, corresponding openings or apertures are then provided in order to enable connection of a converter unit 20 to the lines of the additional second upper power supply circuits II', II". In this case, too, there is again the possibility of additionally also connecting high-voltage luminaire units 150.

Figure 7A:
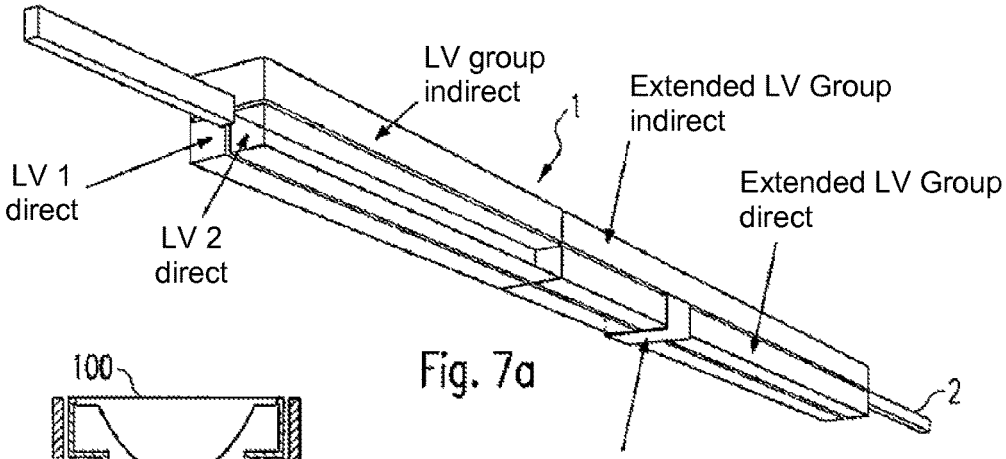
FIGS. 7*a* and 7*b* show possibilities for the joint arrangement of low-voltage luminaire units and high-voltage luminaire units in a light strip system according to the invention.
Figure 7B:
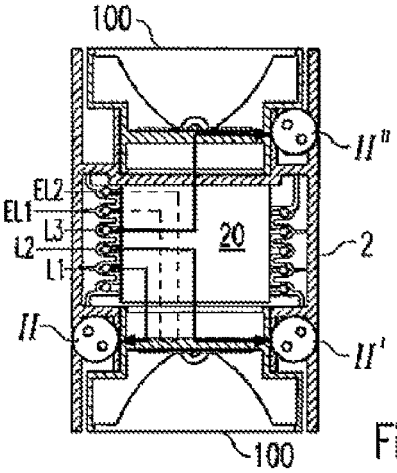

Therefore, an arrangement as shown in FIG. 7*a* in a perspective view and in FIG. 7*b* in a sectional illustration would also ultimately be conceivable. A converter unit 20 in this case supplies two low voltage groups arranged on the lower side of the mounting rail 2 and additionally a further low voltage group on the upper side for indirect lighting. Adjacent to this, extended low voltage groups are formed on the lower side and the upper side of the mounting rail 2, wherein in addition also a high-voltage luminaire module is connected to the mounting rail 2. In this case, this does not necessarily need to be a luminaire module. Instead, this could also be a sensor unit, for example a brightness or motion sensor, via which information relating to automated control of the individual luminaire units is received.

By virtue of the solution according to the invention, the possibility is thus provided of connecting luminaire units which require a low voltage flexibly to a light strip system. The solution is in this case characterized in particular also by the fact that already existing light strip systems can be extended without considerable complexity in order to enable the connection of such luminaire units which contain LED light sources, for example, without each luminaire unit needing to contain a dedicated converter.

The invention claimed is:

1. An elongate light strip system extending in a longitudinal direction for securing and supplying power to luminaire units, wherein the system comprises:

at least one elongate mounting rail defining at least one elongate U-shaped channel sized to receive and secure luminaire units therein, a first power supply extending along the elongate mounting rail for supplying power to the luminaire units, wherein the first power supply includes first lines, which extend along the elongate mounting rail within the elongate channel and which form a first power supply circuit, second lines, which extend along the elongate mounting rail within the elongate channel over a partial length of the first power supply circuit and form a pair of second power supply circuits, which are provided for making electrical contact with the luminaire units, and a converter unit oriented within the elongate channel forming an electrical coupling between the first power supply circuit and the second power supply circuit, to convert a first supply voltage available in the first power supply circuit into a second supply voltage available in the pair of second power supply circuits suitable for operating the luminaire units;

wherein the elongate channel formed within the elongate mounting rail is sized to receive the converter unit substantially within the U-shaped channel:

wherein the converter unit is connected to the second power supply circuit with a plug which is connected to the converter unit via a flexible line;

wherein the pair of second power supply circuits comprise a plurality of pairs of second power supply circuits, wherein the converter unit is arranged in the center of two adjacent pairs of second power supply circuits, when viewed in a direction normal to the elongate mounting rail, and is connected to the two pairs of second power supply circuits.

2. The light strip system as claimed in claim 1, wherein the pairs of second power supply circuits each abut another adjacent pair of second power supply units at their ends and extend, together, substantially over an entire length of the first power supply circuit.

3. The light strip system as claimed in claim 1, wherein the plurality of pairs of second power supply circuits are connected to one another at their ends.

4. The light strip system as claimed in claim 1, wherein the lines of the pair of second power supply circuits are arranged so as to be freely accessible from a fitting side of the elongate mounting rail for the luminaire units.

5. The light strip system as claimed in claim 1, wherein the lines of the first power supply circuit have, at predetermined intervals, contacts for connection with the converter unit.

6. The light strip system as claimed in claim 1, wherein the lines of the first power supply circuit are arranged and mounted in such a way that they enable a substantially free arrangement of the converter unit along the elongate mounting rail.

7. The light strip system as claimed in claim 1, wherein the one of the pair of second power supply circuit are arranged on the side remote from the opening of the elongate mounting rails.

8. The light strip system as claimed in claim 1, wherein the first supply voltage is a high voltage and the second supply voltage is a low voltage.

9. The light strip system as claimed in claim 1, wherein the luminaire units contain LED light sources.

10. The converter unit as claimed in claim 1, wherein a means for making contact with the first power supply circuit have a rotary tap.

11. The light strip system as claimed in claim 1, wherein the elongate channel of the elongate mounting rail is substantially U-shaped and downwardly facing.

12. The light strip system as claimed in claim 1, further comprising a high voltage luminaire unit connected to the first power supply circuit and a low voltage luminaire unit connected to the second power supply circuit.

13. The light strip system as claimed in claim 1, wherein the at least one elongate mounting rail defines two U-shaped mounting channels, one providing a downwardly facing elongate channel and one providing an upwardly facing elongate channel.

14. The light strip system as claimed in claim 1, further comprising a plurality of luminaire units sized to fit substantially entirely within the elongate U-shaped channel.

15. The light strip system as claimed in claim 1, wherein the at least one the elongate U-shaped channel comprises two opposed U-shaped channels, one downwardly facing channel and an upwardly facing channel, with one of the pair of second power supply circuits located in each of the downwardly and upwardly facing channels.

16. The light strip system as claimed in claim 15, further comprising a plurality of luminaire units sized to fit within the elongate U-shaped downwardly and upwardly facing channels.

17. The light strip system as claimed in claim 15, further comprising a plurality of luminaire units sized to fit substantially entirely within the elongate U-shaped downwardly and upwardly facing channels.

18. An elongate light strip system extending in a longitudinal direction for securing and supplying power to luminaire units, wherein the system comprises:

a plurality of luminaire units a plurality elongate mounting rails defining opposed upwardly facing and a downwardly facing U-shaped channels sized to receive and secure the luminaire units therein, a first power supply extending along the elongate mounting rails for supplying power to the luminaire units, wherein the first power supply includes first lines, which extend along the elongate mounting rails within the elongate channel and which form a first power supply circuit, second lines, which extend along the elongate mounting rails within the elongate channel over a length of the first power supply circuit and form a pair of second power supply circuits, one in each of the upwardly facing and the downwardly facing U-shaped channels to make electrical contact with the luminaire units, and a converter unit oriented within the elongate channel forming an electrical coupling between the first power supply circuit and the pair of second power supply circuits, to convert a first supply voltage available in the first power supply circuit;

wherein the pair of second power supply circuits comprise a plurality of pairs of second power supply circuits, wherein the converter unit is arranged in the center of two adjacent pairs of second power supply circuits, when viewed in a direction normal to the elongate mounting rail, and is connected to the two pairs of second power supply circuits.

* * * * *